US010204538B2

(12) United States Patent
Kim et al.

(10) Patent No.: US 10,204,538 B2
(45) Date of Patent: Feb. 12, 2019

(54) IMAGE PROCESSING CIRCUIT AND DISPLAY DEVICE INCLUDING THE SAME

(71) Applicant: Samsung Display Co., Ltd., Yongin-si, Gyeonggi-do (KR)

(72) Inventors: Heendol Kim, Yongin-si (KR); Jai-hyun Koh, Hwaseong-si (KR); Seokyun Son, Suwon-si (KR); Kuk-hwan Ahn, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 176 days.

(21) Appl. No.: 15/158,534

(22) Filed: May 18, 2016

(65) Prior Publication Data

US 2017/0061847 A1 Mar. 2, 2017

(30) Foreign Application Priority Data

Aug. 24, 2015 (KR) ..... 10-2015-0119076

(51) Int. Cl.
*G09G 3/20* (2006.01)
*G09G 3/36* (2006.01)

(52) U.S. Cl.
CPC ..... *G09G 3/2003* (2013.01); *G09G 3/3607* (2013.01); *G09G 2300/0452* (2013.01); *G09G 2320/0276* (2013.01); *G09G 2320/0666* (2013.01); *G09G 2340/0457* (2013.01); *G09G 2340/06* (2013.01); *G09G 2360/16* (2013.01)

(58) Field of Classification Search
CPC ..... G09G 3/2003; G09G 3/3607; G09G 2320/0233; G09G 2320/0242; G09G 2320/0626; G09G 2320/0673; G09G 2320/0646; G09G 5/02; G09G 5/06; G09G 5/363; G09G 2320/0666; G09G 2340/00; G09G 2340/04; G09G 2340/045; G09G 2340/0457; G09G 2340/16; G06T 11/001
See application file for complete search history.

(56) References Cited

U.S. PATENT DOCUMENTS 7,123,277 B2 10/2006 Brown Elliott et al.
8,704,847 B2 * 4/2014 Higgins ..... G06T 11/001 345/55
8,933,959 B2 1/2015 Brown Elliott et al.
2007/0279372 A1 * 12/2007 Brown Elliott ..... G09G 3/3426 345/102
2011/0043553 A1 * 2/2011 Brown Elliott ..... G09G 3/3406 345/694
2011/0057950 A1 * 3/2011 Kim ..... G09G 5/02 345/602

* cited by examiner

*Primary Examiner* — Sardis F Azongha
(74) *Attorney, Agent, or Firm* — Lewis Roca Rothgerber Christie LLP

(57) ABSTRACT

An image processing circuit includes a mapper configured to convert an image signal into an intermediate data signal, and a renderer configured to convert the intermediate data signal into a data signal, wherein the renderer includes a memory configured to store the intermediate data signal and a flag signal, and a rendering circuit configured to output a data signal corresponding to a current line in response to a next intermediate data signal corresponding to a next line, to output a current intermediate data signal corresponding to the current line from the memory, and to output a previous flag signal corresponding to a previous line from the memory.

20 Claims, 10 Drawing Sheets

411

| | | |
|---|---|---|
| -64 | 128 | -64 |

413

| | | |
|---|---|---|
| 64 | 128 | 64 |

415

| | | |
|---|---|---|
| 128 | 128 | 0 |

434_1

| | | |
|---|---|---|
| 0 | 1 | 0 |
| 1 | 1 | 1 |
| 0 | 1 | 0 |

IMAGE PROCESSING CIRCUIT AND DISPLAY DEVICE INCLUDING THE SAME

CROSS-REFERENCE TO RELATED APPLICATION

This U.S. non-provisional patent application claims priority to, and the benefit of, Korean Patent Application No. 10-2015-0119076, filed on Aug. 24, 2015, with the Korean Intellectual Property Office (KIPO), the entire content of which is hereby incorporated by reference.

BACKGROUND

1. Field

The present disclosure herein relates to an image processing circuit and a display device including the same.

2. Description of the Related Art

In general, a display device expresses colors by using the three primary colors (e.g., red, green, and blue). The display panel, e.g., includes sub pixels that respectively correspond to red, green, and blue. Recently, in order to increase the brightness of a displayed image, a technique of further including a white sub pixel is being investigated. That is, a PenTile technique for using a two-pixels-with-four-sub-pixels design instead of the conventional two-pixels-with-six-sub-pixels design has been developed.

A display device employing PenTile technique includes a rendering module for compensating resolution deterioration due to the reduction of the number of sub pixels. The rendering module converts red, green, and blue image signals provided from the outside (e.g., from external to the rendering module or the display device) into red, green, blue, and white data signals and adjusts the brightness of a backlight unit, thereby improving (e.g., increasing) the brightness of an image.

SUMMARY

Aspects of embodiments of the present disclosure are directed toward an image processing circuit for reducing or minimizing the size of a memory utilized (e.g., necessary) for an operation of a rendering module (e.g., a renderer).

Aspects of embodiments of the present disclosure are directed toward a display device including an image processing circuit for reducing or minimizing the size of a memory necessary for an operation of a rendering module.

According to an embodiment of the inventive concept, there is provided an image processing circuit including: a mapper configured to convert an image signal into an intermediate data signal; and a renderer configured to convert the intermediate data signal into a data signal, wherein the renderer includes: a memory configured to store the intermediate data signal and a flag signal; and a rendering circuit configured to output a data signal corresponding to a current line in response to a next intermediate data signal corresponding to a next line, to output a current intermediate data signal corresponding to the current line from the memory, and to output a previous flag signal corresponding to a previous line from the memory.

In an embodiment, the memory includes: a line buffer configured to store the current intermediate data signal; and a flag buffer configured to store the previous flag signal.

In an embodiment, the rendering circuit is configured to calculate a next flag signal corresponding to the next line in response to the current intermediate data signal, to calculate the next intermediate data signal, and to calculate a previous flag signal corresponding to a previous line from the flag buffer, and to store the next flag signal in the flag buffer.

In an embodiment, the rendering circuit includes: a filtering circuit configured to output a plurality of filtering data signals by calculating the current intermediate data signal and each of a plurality of filter coefficients; and a selection circuit configured to output one of the plurality of filtering data signals as the data signal in response to the current intermediate data signal, the next intermediate data signal, and the previous flag signal corresponding to the previous line from the flag buffer.

In an embodiment, the filtering circuit includes: a first filter configured to provide a first filter coefficient; a brightness calculator configured to calculate a brightness of the current intermediate data signal; a first calculator configured to calculate the first filter coefficient and an output of the brightness calculator; a second filter configured to provide a second filter coefficient; a second calculator configured to calculate the current intermediate data signal and the second filter coefficient; a third calculator configured to calculate an output of the first calculator and an output of the second calculator; a third filter configured to provide a third filter coefficient; a fourth calculator configured to calculate the current intermediate data signal and the third filter coefficient; a fifth calculator configured to calculate an output of the second calculator and an output of the third calculator; a fourth filter configured to provide a fourth filter coefficient; and a six calculator configured to calculate the current intermediate data signal and the fourth filter coefficient.

In an embodiment, the first filter is a sharpening filter; the second filter is a re-sampling filter; the third filter is a self-sharpening filter; and the fourth filter is a box filter.

In an embodiment, the selection circuit includes: a first filter circuit configured to output a first selection signal in response to the current intermediate data signal, to output the next intermediate data signal, and to output the previous flag signal corresponding to the previous line from the flag buffer; a first multiplexer configured to output one of an output signal of the fifth calculator and an output signal of the sixth calculator in response to the first selection signal; a second filter circuit configured to output a second selection signal in response to the current intermediate data signal, to output the next intermediate data signal, and to output the previous flag signal corresponding to the previous line from the flag buffer; and a second multiplexer configured to output one of an output signal from the third calculator and an output signal from the first multiplexer as the data signal in response to the second selection signal.

In an embodiment, the image signal includes a first color signal, a second color signal, and a third color signal, and the intermediate data signal includes the first color signal, the second color signal, the third color signal, and a fourth color signal.

In an embodiment, the first filter circuit is further configured to output a color flag signal representing whether each of the first color signal, the second color signal, the third color signal, and the fourth color signal of the current intermediate data signal is greater than a reference value; wherein the second filter circuit is further configured to output a saturation flag signal according to a pattern of the current intermediate data signal; and wherein the flag buffer is configured to store a current flag signal including the color flag signal and the saturation flag signal.

According to an embodiment of the inventive concept, there is provided a display device including: a display panel including a plurality of pixels displaying an image corresponding data signals; and an image processing circuit configured to receive an image signal, to convert the image signal into a data signal of the data signals, and to provide the data signal to the display panel, wherein the image processing circuit includes: a mapper configured to convert the image signal into an intermediate data signal; and a renderer configured to convert the intermediate data signal into the data signal, the renderer including: a memory configured to store the intermediate data signal and a flag signal; and a rendering circuit configured to output the data signal corresponding to a current line in response to a next intermediate data signal corresponding to a (k+1)th line among a plurality of lines of the display panel, to output a current intermediate data signal corresponding to a kth line from the memory, and to output a previous flag signal corresponding to a (k−1)th line from the memory.

In an embodiment, the memory includes: a line buffer configured to store the current intermediate data signal; and a flag buffer configured to store the previous flag signal.

In an embodiment, the rendering circuit is configured to calculate a current flag signal in response to the current intermediate data signal, to calculate the next intermediate data signal, to calculate the previous flag signal corresponding to the (k−1)th line from the flag buffer, and to store the current flag signal in the flag buffer.

In an embodiment, the rendering circuit includes: a filtering circuit configured to output a plurality of filtering data signals by calculating the current intermediate data signal and each of a plurality of filter coefficients; and a selection circuit configured to output one of the plurality of filtering data signals as the data signal in response to the current intermediate data signal, the next intermediate data signal, and the previous flag signal corresponding to a previous line from the flag buffer.

In an embodiment, the filtering circuit includes: a first filter configured to provide a first filter coefficient; a brightness calculator configured to calculate a brightness of the current intermediate data signal; a first calculator configured to calculate the first filter coefficient and an output of the brightness calculator; a second filter configured to provide a second filter coefficient; a second calculator configured to calculate the current intermediate data signal and the second filter coefficient; a third calculator configured to calculate an output of the first calculator and an output of the second calculator; a third filter configured to provide a third filter coefficient; a fourth calculator configured to calculate the current intermediate data signal and the third filter coefficient; a fifth calculator configured to calculate an output of the second calculator and an output of the third calculator; a fourth filter configured to provide a fourth filter coefficient; and a six calculator configured to calculate the current intermediate data signal and the fourth filter coefficient.

In an embodiment, the first filter is a sharpening filter; the second filter is a re-sampling filter; the third filter is a self-sharpening filter; and the fourth filter is a box filter.

In an embodiment, the selection circuit includes: a first filter circuit configured to output a first selection signal in response to the current intermediate data signal, to output the next intermediate data signal, and to output the previous flag signal corresponding to the previous line from the flag buffer; a first multiplexer configured to output one of an output signal of the fifth calculator and an output signal of the sixth calculator in response to the first selection signal; a second filter circuit configured to output a second selection signal in response to the current intermediate data signal, to output the next intermediate data signal, and to output the previous flag signal corresponding to the previous line from the flag buffer; and a second multiplexer configured to output one of an output signal from the third calculator and an output signal from the first multiplexer as the data signal in response to the second selection signal.

In an embodiment, the image signal includes a first color signal, a second color signal, and a third color signal, and the intermediate data signal includes the first color signal, the second color signal, the third color signal, and a fourth color signal.

In an embodiment, the first filter circuit is further configured to output a color flag signal representing whether each of the first color signal, the second color signal, the third color signal, and the fourth color signal of the current intermediate data signal is greater than a reference value; the second filter circuit is further configured to output a saturation flag signal according to a pattern of the current intermediate data signal; and the flag buffer is configured to store a current flag signal including the color flag signal and the saturation flag signal.

In an embodiment, the flag buffer is configured to store previous flag signals corresponding to a plurality of pixels in one line, the plurality of pixels being sequentially arranged along a first direction of the display panel, and the previous flag signals including the previous flag signal.

In an embodiment, the line buffer is configured to store the intermediate data signal corresponding to a plurality of pixels in one line, the plurality of pixels being sequentially arranged along the first direction of the display panel.

BRIEF DESCRIPTION OF THE DRAWINGS

The accompanying drawings are included to provide a further understanding of the inventive concept, and are incorporated in and constitute a part of this specification. The drawings illustrate exemplary embodiments of the inventive concept and, together with the description, serve to explain principles of the inventive concept.

In the drawings.

DETAILED DESCRIPTION

Hereinafter, embodiments of the inventive concept are described in more detail with reference to the accompanying drawings.

Figure 1:
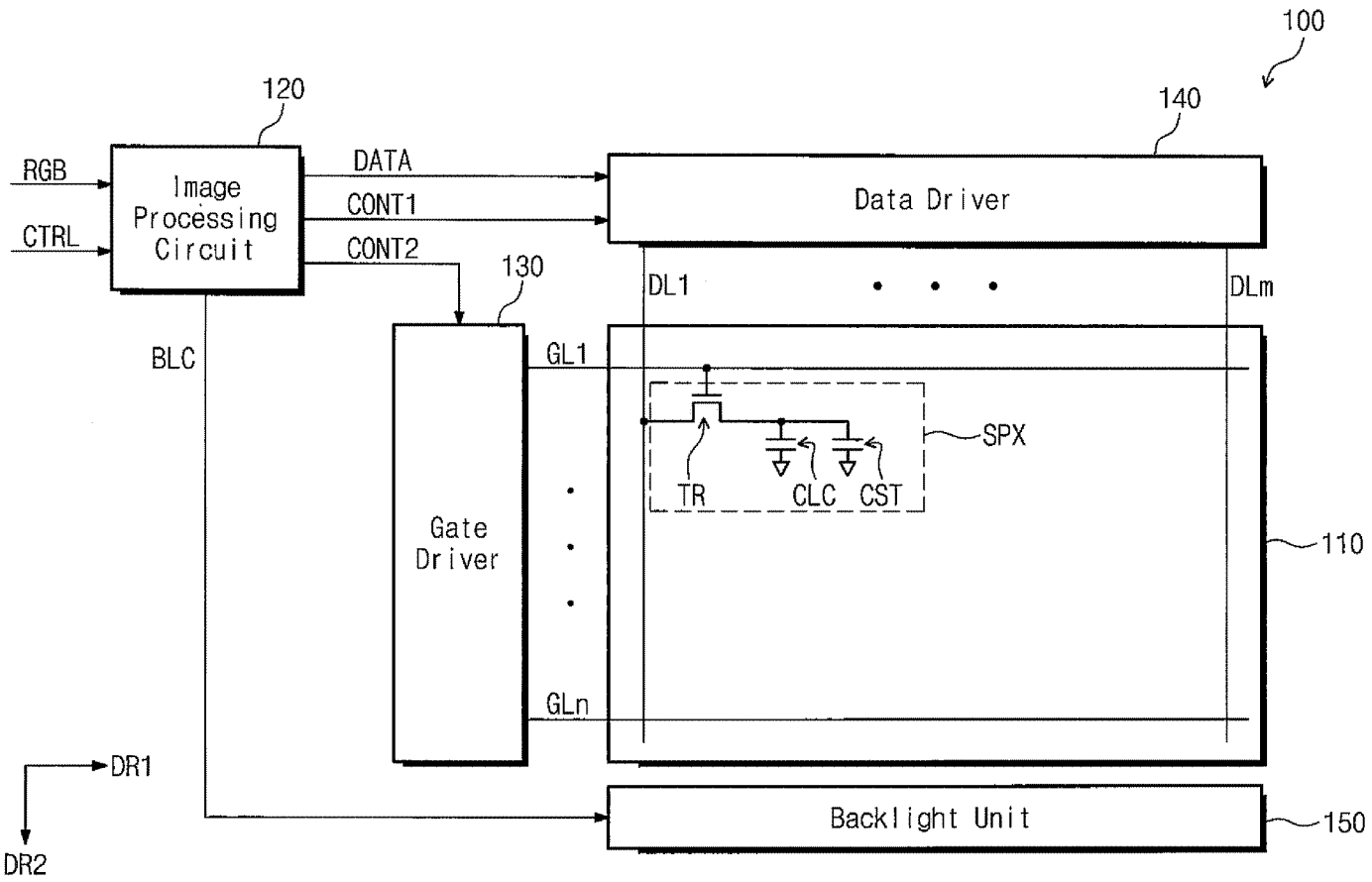
FIG. 1 is a block diagram illustrating a display device according to an embodiment of the inventive concept.

FIG. 1 is a block diagram illustrating a display device according to an embodiment of the inventive concept.

Referring to FIG. 1, a display device 100 includes a display panel 110, an image processing circuit 120, a gate driver 130, a data driver 140, and a backlight unit (e.g., a backlight) 150.

The display panel 110 displays an image. In this embodiment, although it is described as one example that the display panel 110 is a liquid crystal display panel, the display panel 110 may be a different type (kind) of display panel that utilizes the backlight unit 150.

The display panel 110 includes a plurality of gate lines GL1 to GLn extending in a first direction DR1, a plurality of data lines DL1 to DLm extending in a second direction DR2, and a plurality of sub pixels SPX arranged in a crossing region where the plurality of gate lines GL1 to GLn and the plurality of data lines DL1 to DLm cross. The plurality of data lines DL1 to DLm and the plurality of gate lines GL1 to GLn are insulated from each other. Each of the sub pixels SPX includes a thin film transistor TR, a liquid crystal capacitor CLC, and a storage capacitor CST.

Each of the plurality of sub pixels PX is formed of the same structure. Accordingly, as a configuration of one sub pixel is described, description of other sub pixels SPX may be omitted. The thin film transistor TR of the sub pixel SPX includes a gate electrode connected to the first gate line GL1 among the plurality of gate lines GL1 to GLn, a source electrode connected to the first data line DL1 among the plurality of data lines DL1 to DLm, and a drain electrode connected to the liquid crystal capacitor CLC and the storage capacitor CST. One end of each of the liquid crystal capacitor CLC and the storage capacitor CST is connected in parallel to the drain electrode of the thin film transistor TR. The other end of each of the liquid crystal capacitor CLC and the storage capacitor CST is connected to a common voltage source (for providing a common voltage).

The image processing circuit 120 receives an image signal RGB and a control signal CTRL from the outside (e.g., from a source external to the display device). The control signals CTRL, for example, include a vertical sync signal, a horizontal sync signal, a main clock signal, and a data enable signal. The image processing circuit 120 converts an image signal DATA into a data signal DATA processed to correspond to an operating condition of the display panel 110. The image processing circuit 120 outputs a first control signal CONT1 and a second control signal CONT2 on the basis of a control signal CTRL. The image processing circuit 120 provides a data signal DATA and a first control signal CONT1 to the data driver 140 and provides a second control signal CONT2 to the gate driver 130. The first control signal CONT1 includes a horizontal sync start signal, a clock signal, and a line latch signal, and the second control signal CONT2 includes a vertical sync start signal, an output enable signal, and a gate pulse signal. The image processing circuit 120 may change a data signal DATA diversely (e.g., in a variety of ways) according to the arrangement of the sub pixels SPX in the display panel 110 and a display frequency, and then output the changed data signal DATA. The image processing circuit 120 outputs a backlight control signal BLC for controlling the backlight unit 150.

The gate driver 130 drives the gate lines GL1 to GLn in response to the second control signal CONT2 from the image processing circuit 120. The gate driver 130 includes a gate driving integrated circuit (IC). The gate driver 130 may be implemented with a circuit using an oxide semiconductor, an amorphous semiconductor, a crystalline semiconductor, and/or a polycrystalline semiconductor, and may be formed in a set or predetermined area of the display panel 110.

The data driver 140 provides a driving voltage to the data lines DL1 to DLm in response to the data signal DATA and the first control signal CONT1 from the image processing circuit 120.

The backlight unit 150 may be arranged at a lower part of the display panel 110 to face the sub pixels SPX or may be arranged at one side of the display panel 110. The backlight unit 150 operates in response to the backlight control signal BLC from the image processing circuit 120.

Figure 2:
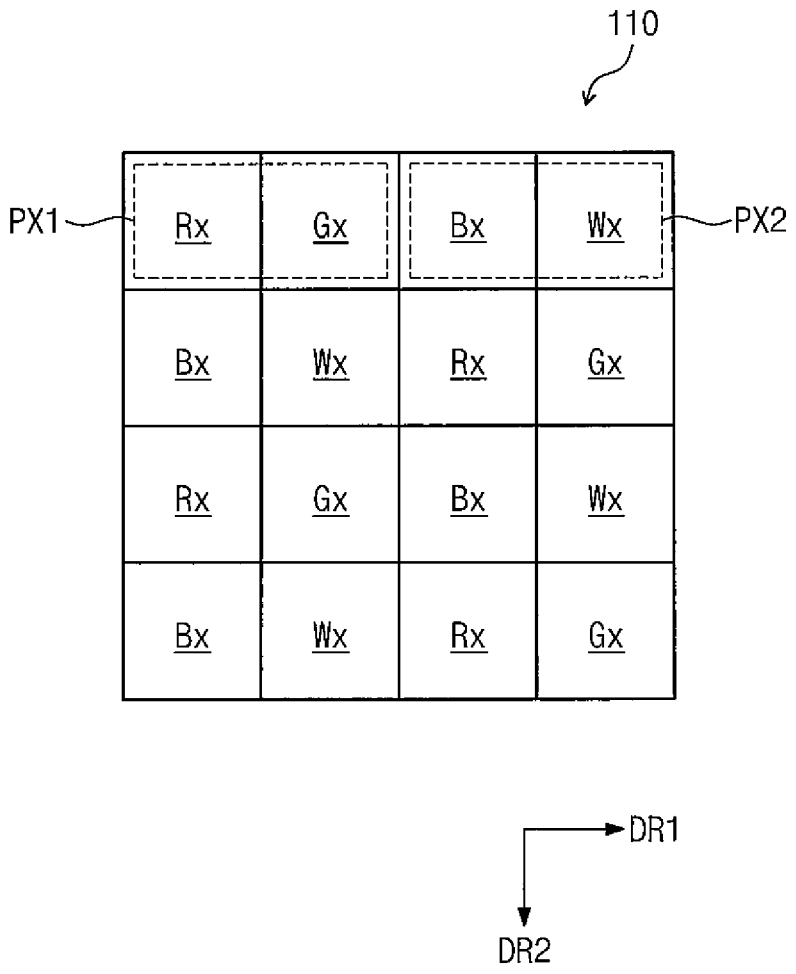
FIG. 2 is a view illustrating an arrangement of pixels provided in a display panel shown in FIG. 1.

FIG. 2 is a view illustrating an arrangement of pixels provided in the display panel shown in FIG. 1.

Referring to FIG. 2, the display panel 110 includes a first pixel PX1 and a second pixel PX2. The first pixel PX1 includes a first sub pixel Rx and a second sub pixel Gx. The second pixel PX2 includes a third sub pixel Bx and a fourth sub pixel Wx. The first pixel PX1 and the second pixel PX2 are arranged sequentially and alternately along a first direction DR1 and in the same manner, are sequentially and alternately arranged along a second direction DR2 (that is substantially orthogonal to the first direction DR1).

In this specification, although the first to fourth sub pixels Rx, Gx, Bx, and Wx are described on the basis of the display panel 110 where RGBW displaying red, green, blue, and white colors are applied, the inventive concept is also applied to a display panel with other suitable multi-primary colors (e.g., RGBY, RGBC, CMYW, and so on).

Figure 3:
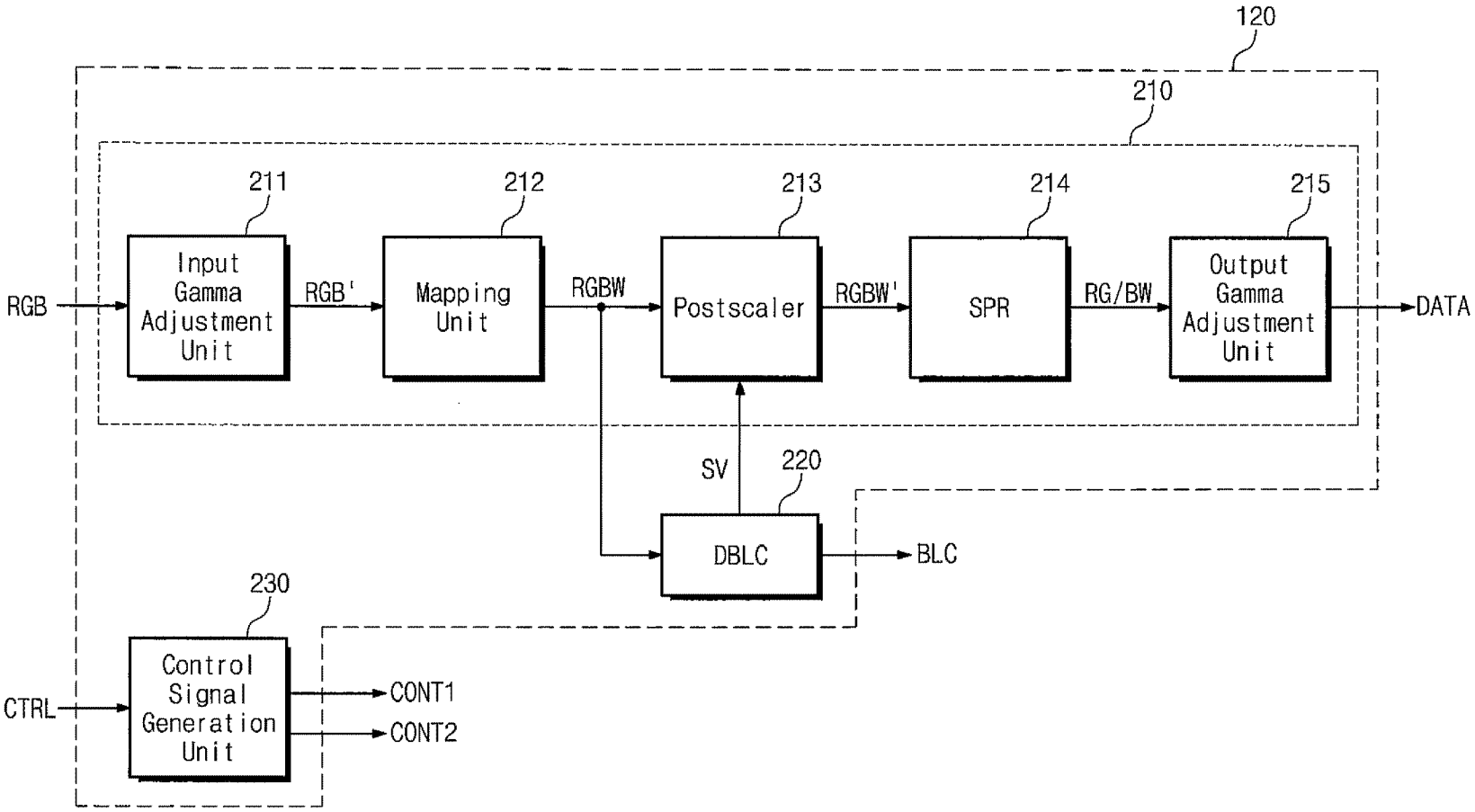
FIG. 3 is a block diagram illustrating a configuration of an image processing circuit shown in FIG. 1.

FIG. 3 is a block diagram illustrating a configuration of the image processing circuit shown in FIG. 1.

Referring to FIG. 3, the image processing circuit 120 includes a rendering module (e.g., the renderer) 210, a backlight control unit (e.g., a backlight controller) 220, and a control signal generation unit (e.g., a control signal generator) 230. The rendering module 210 includes an input gamma adjustment unit (e.g., an input gamma adjuster) 211, a mapping unit (e.g., a mapper) 212, a postscaler 213, a sub-pixel rendering unit (e.g., a sub-pixel renderer) 214, and an output gamma adjustment unit (e.g., an output gamma adjuster) 215.

The input gamma adjustment unit 211 receives an image signal RGB from the outside (e.g., from a source external to the display device). The input gamma adjustment unit 211 outputs a gamma data signal RGB' that is linearized to allow gamma characteristics of the image signal RGB to be proportional to brightness. The gamma data signal RGB' includes a first color signal, a second color signal, and a third color signal. In this embodiment, the first color signal, the second color signal, and the third color signal include a red signal R, a green signal G, and a blue signal B, respectively. The mapping unit 212 maps the gamma data signal RGB' into a first intermediate data signal RGBW including a white signal W in addition to the red signal R, the green signal G, and the blue signal B.

The backlight control unit 220 generates a histogram corresponding to image characteristics of the first intermediate data signal RGBW and generates a backlight control signal BLC on the basis of the generated histogram. The backlight control signal BLC is provided to the backlight unit 150 shown in FIG. 1. Alternatively, the backlight control unit 220 provides a scaling signal SV corresponding to the backlight control signal BLC to the postscaler 213.

The postscaler 213 outputs a second intermediate data signal RGBW' for adjusting a brightness value of the first intermediate data signal RGBW in consideration of the scaling signal SV.

The sub pixel rendering unit 214 outputs a rendering signal RG/BW in response to the second intermediate data signal RGBW'. The output gamma adjustment unit 215 outputs a non-linear data signal DATA by applying an inverse gamma function to the rendering signal RG/BW. The output data signal DATA is provided to the data driver 140 shown in FIG. 1.

The control signal generation unit 230 outputs a first control signal CONT1 for controlling the data driver 140 of FIG. 1 and a second control signal CONT2 for controlling the gate driver 130 of FIG. 1 in response to a control signal CTRL provided from the outside (e.g., from a source external to the display device).

Figure 4A:
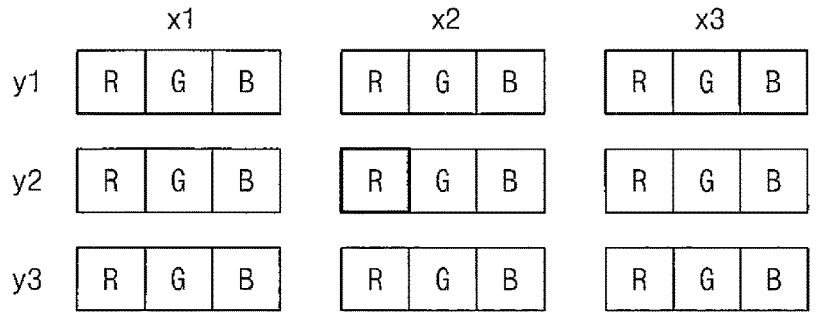
FIGS. 4A-4C are views illustrating mapping and rendering processes of a mapping unit and a sub pixel rendering unit shown in FIG. 2.
Figure 4B:
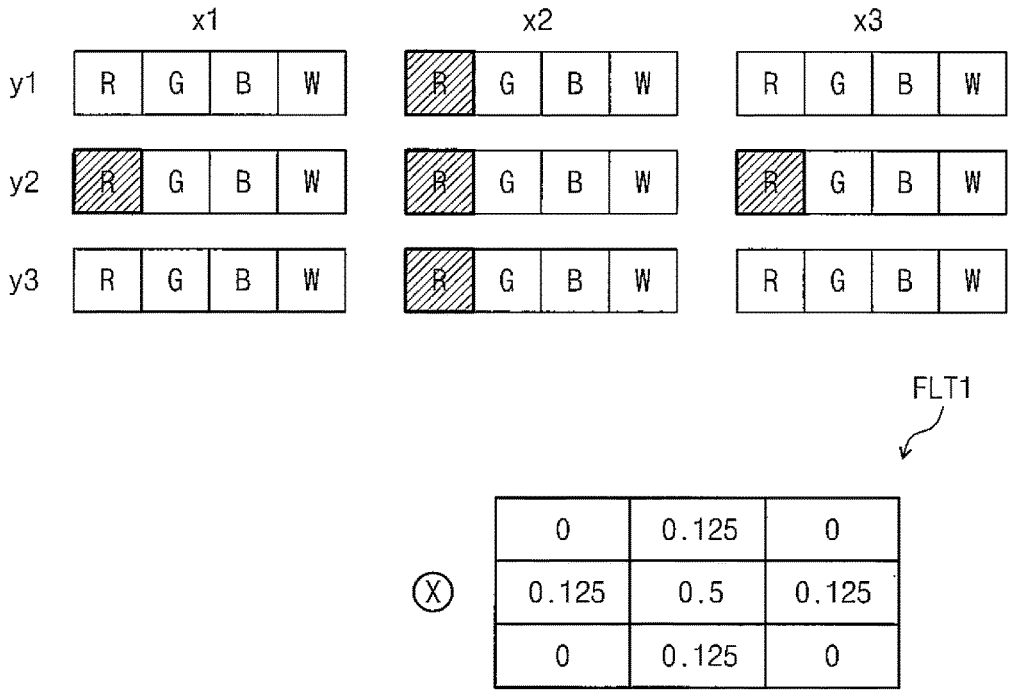
Figure 4C:
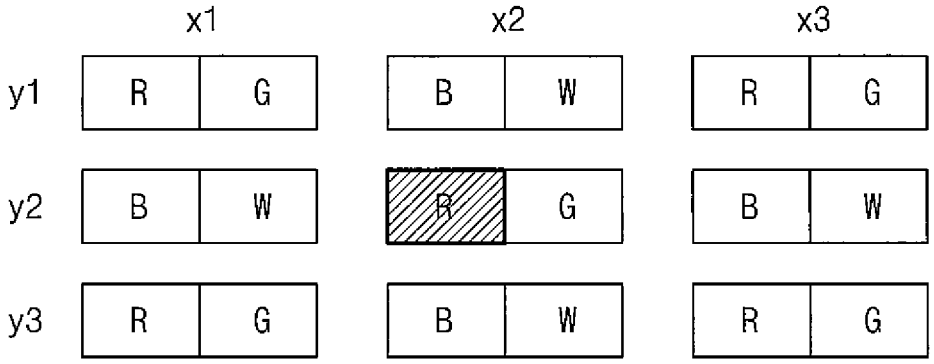

FIGS. 4A to 4C are views illustrating mapping and rendering processes of the mapping unit 212 and the sub pixel rendering unit 214 shown in FIG. 2. In FIG. 4A, each pixel in a three-pixel structure is displayed in x-y coordinates, and FIGS. 4B and 4C represent a structure in which (x, y) coordinates in the three-pixel structure are matched to a four-pixel structure and a PenTile pixel. Because the sub pixel rendering unit 214 employs a diamond filter using nine pixels, only three pixels are shown as one example in FIG. 4A, for convenience of illustration.

Referring to FIGS. 3, 4A, and 4B, the mapping unit 212 maps a gamma data signal RGB' including the red signal R, the green signal G, and the blue signal B corresponding to each pixel into a first intermediate data signal RGBW including the red signal R, the green signal G, the blue signal B, and the white signal W.

Referring to FIGS. 3, 4B, and 4C, the first intermediate data signal RGBW outputted from the mapping unit 212, that is, the red signal R, the green signal G, the blue signal B, and the white signal W, is converted into a second intermediate data signal RGBW' obtained by reflecting the scaling signal SV through the postscaler 213. The sub pixel rendering unit 214 may render the second intermediate data signal RGBW' by using a diamond filter. For example, the sub pixel rendering unit 214 may generate the red signal R corresponding to a red sub pixel in a PenTile pixel structure by passing a reference red signal R in a pixel of the coordinates (x2, y2) and eight red signals R adjacent to the reference red signal R through a diamond filter FLT1.

As shown in FIG. 4B, scale coefficients corresponding to respective nine specified areas are stored in the diamond filter FLT1 and the sub pixel rendering unit 214 may multiply each of the nine red signals by a scale coefficient of a corresponding position and calculate the multiplication sum as a rendering value of the reference red signal R. Herein, the sum of scale coefficients at specified positions is set to be 1. In a similar manner, green, blue, and white signals may be rendered. However, a rendering method using the diamond filter FLT1 requires a memory for storing color signals of at least three lines and a complex arithmetic logic circuit.

Figure 5:
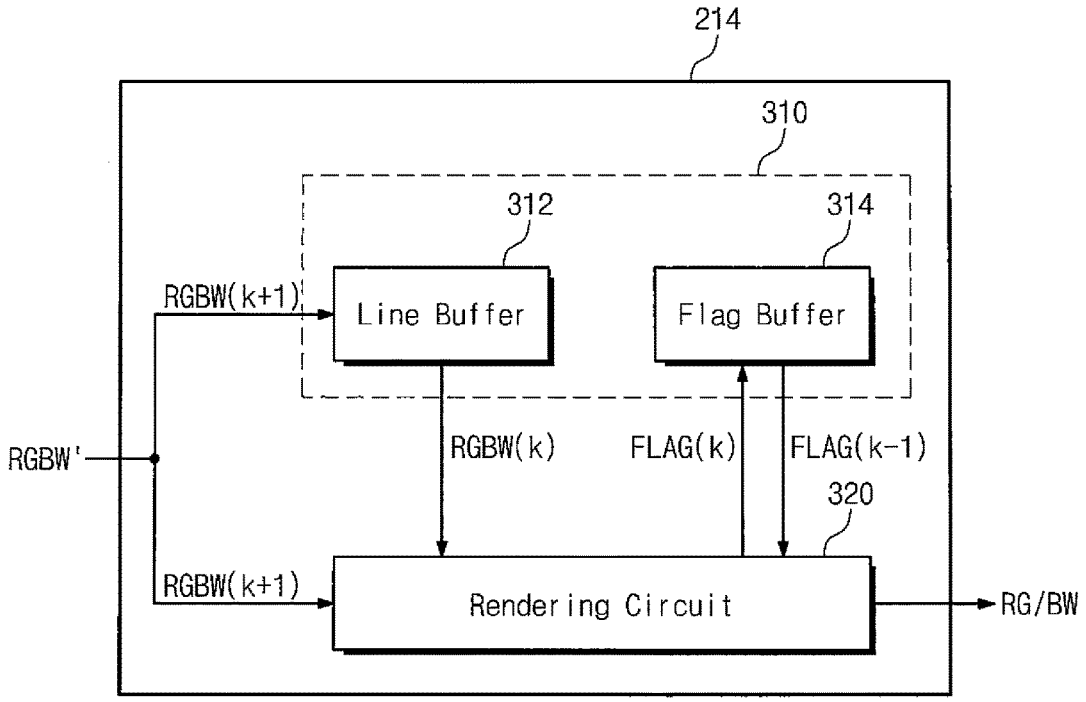
FIG. 5 is a block diagram illustrating a configuration of a sub pixel rendering unit shown in FIG. 3 according to an embodiment of the inventive concept.

FIG. 5 is a block diagram illustrating a configuration of the sub pixel rendering unit of FIG. 3 according to an embodiment of the inventive concept.

Referring to FIG. 5, the sub pixel rendering unit 214 includes a memory 310 and a rendering circuit 320. The memory 310 includes a line buffer 312 and a flag buffer 314.

The line buffer 312 stores the second intermediate data signal RGBW' provided from the postscaler 213 of FIG. 3 as the next intermediate data signal RGBW(k+1)). The flag buffer 314 provides a previous flag signal FLAG(k−1) to the rendering circuit 320 and stores the current flag signal FLAG(k) provided from the rendering circuit 320.

The rendering circuit 320 receives the second intermediate data signal RGBW' provided from the postscaler 213 as the next intermediate data signal RGBW'(k+1) and receives the current intermediate data signal RGBW(k) from the line buffer 312 and a previous flag signal FLAG(k−1) from the flag buffer 314 to output a rendering signal RG/BW. The rendering signal RG is provided to the first pixel PX1 of FIG. 2 and the rendering signal BW is provided to the second pixel PX2 of FIG. 2.

Figure 6:
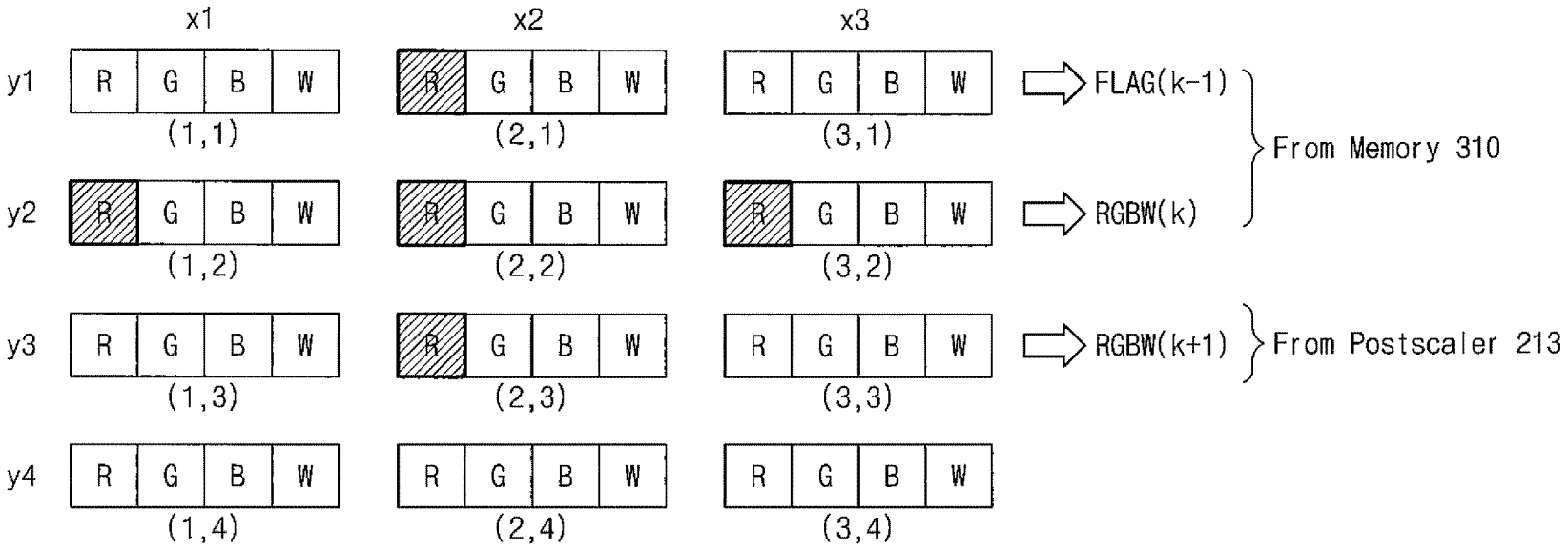
FIG. 6 is a conceptual diagram illustrating a second intermediate data signal corresponding to each of the pixels of a display panel shown in FIG. 1 in order to describe operations of a sub pixel rendering unit shown in FIG. 5.

FIG. 6 is a conceptual diagram illustrating a second intermediate data signal corresponding to each of the pixels of the display panel shown in FIG. 1 in order to describe operations of the sub pixel rendering unit shown in FIG. 5. Referring to FIG. 6, each pixel in a display panel is expressed in terms of x-y coordinates and/or (x, y) coordinates.

Referring to FIGS. 5 and 6, it is assumed that the second intermediate data signal RGBW' provided from the postscaler 213 of FIG. 3 is provided to the sub pixel rendering unit 214 in the order of coordinates (1, 1), (2, 1), (3, 1), . . . , (1, 2), (2, 2), (3, 2), . . . , (1, 3), (2, 3), and (3, 3). In the description below, the current line k corresponds to the y coordinate being y2; the next line k+1 corresponds to the y coordinate being y3; and a previous line k−1 corresponds to the y coordinate being y1.

When receiving the next intermediate data signal RGBW (k+1) corresponding to the next line (k+1 corresponding to y3) from the postscaler 213 of FIG. 3, the rendering circuit 320 receives the current intermediate data signal RGBW(k) corresponding to the current line (k corresponding to y2) from the line buffer 312. The rendering circuit 320 receives a previous flag signal FLAG(k−1) corresponding to a previous line (k−1 corresponding to y1) from the flag buffer 314.

For example, the red signal R corresponding to the coordinates (2, 2) may be converted into the red signal R corresponding to a red sub pixel of the coordinates (2, 2) in a PenTile pixel structure on the basis of, for example, I) the next intermediate data signal RGBW(k+1) corresponding to an adjacent position on the same line y2, that is, the pixel of the coordinates (1, 2) and the pixel of the coordinates (3, 2); II) the next intermediate data signal RGBW(k+1) corresponding to the pixels of the coordinates (1, 3), (2, 3), and (3, 3) disposed at the next line y3; and III) a previous flag signal FLAG(k−1) corresponding to the pixels of the coordinates (1, 1), (2, 1), and (3, 1) disposed at a previous line y1.

Figure 7:
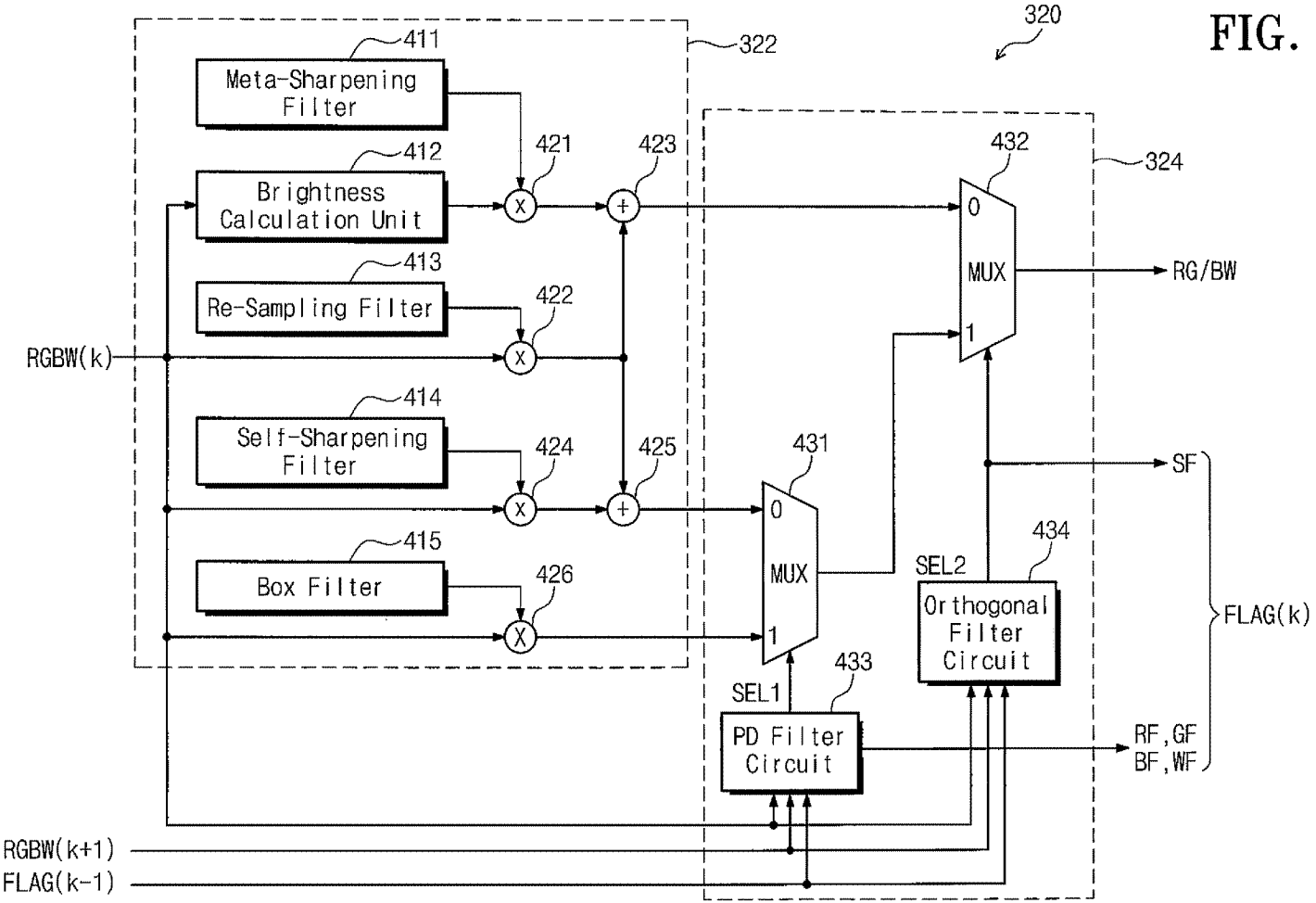
FIG. 7 is a view illustrating a configuration of a sub pixel rendering unit shown in FIG. 5.
Figures 8, 9, 10, 11, 12:
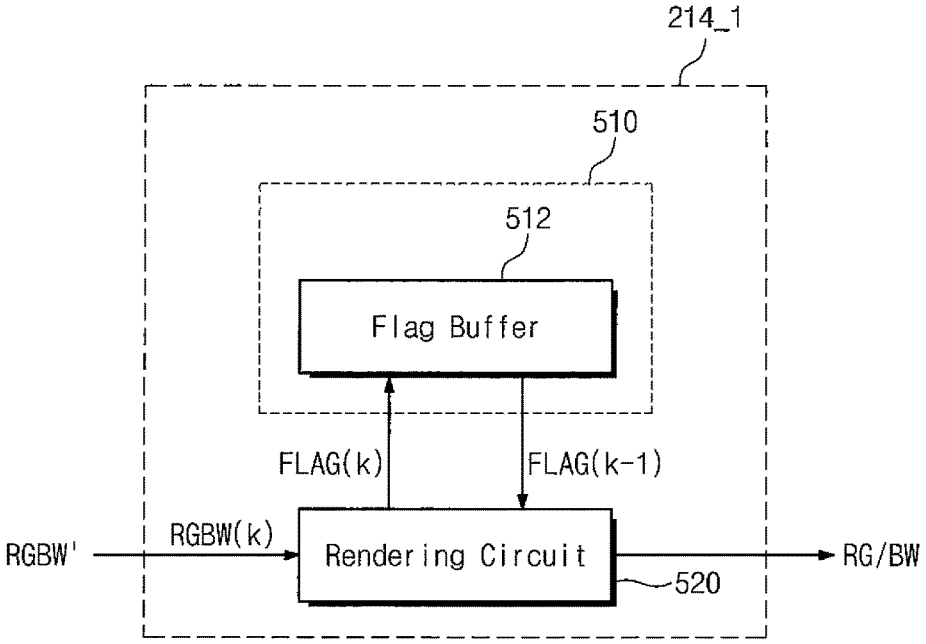
FIG. 8 is a view illustrating a filter coefficient of a meta-sharpening filter shown in FIG. 7.
FIG. 9 is a view illustrating a filter coefficient of a re-sampling filter shown in FIG. 7.
FIG. 10 is a view illustrating a filter coefficient of a box filter shown in FIG. 7.
FIG. 11 is a view illustrating a filter coefficient of an orthogonal filter in an orthogonal filter circuit shown in FIG. 7.
FIG. 12 is a view illustrating a configuration of a sub pixel rendering unit of FIG. 3 according to another embodiment of the inventive concept.

FIG. 7 is a view illustrating a configuration of the sub pixel rendering unit shown in FIG. 5. FIG. 8 is a view illustrating a filter coefficient of a meta-sharpening filter shown in FIG. 7. FIG. 9 is a view illustrating a filter coefficient of a re-sampling filter shown in FIG. 7. FIG. 10 is a view illustrating a filter coefficient of a box filter shown in FIG. 7. FIG. 11 is a view illustrating a filter coefficient of an orthogonal filter in an orthogonal filter circuit shown in FIG. 7.

Referring to FIG. 7, the rendering circuit 320 includes a filtering circuit 322 and a selection circuit 324. The filtering circuit 322 outputs a plurality of filtering signals by calculating a current intermediate data signal RGBW(k) and a plurality of filter coefficients. The selection circuit 324 outputs one of a plurality of filtering data signals outputted from the filtering circuit 322 as a rendering signal RG/BW in response to a next intermediate data signal RGBW(k+1), a previous flag signal FLAG(k−1) from the flag buffer 314 shown in FIG. 5, and a current flag signal FLAG(k).

The filtering circuit 322 includes a meta-sharpening filter 411, a brightness calculation unit (e.g., a brightness calculator) 412, a re-sampling filter 413, a self-sharpening filter 414, a box filter 415, and operators 421 to 425.

The meta-sharpening filter 411 is a filter for emphasizing (e.g., making more prominent) a small portion including a high frequency component such as an edge. The meta-sharpening filter 411 provides a sharpening filter coefficient for providing a clear image by brightening a bright pixel to be brighter and darkening a dark pixel to be darker. As shown in FIG. 8, the meta-sharpening filter 411 may include a filter coefficient of a one-by-three (1*3) size.

The brightness calculation unit 412 calculates the brightness of the current intermediate data signal RGBW(k). The operator 421 multiplies a brightness value outputted from the brightness calculation unit 412 and a filter coefficient of the meta-sharpening filter 411.

The re-sampling filter 413 provides a filter coefficient for energy sharing. As shown in FIG. 9, the re-sampling filter 413 may include a filter coefficient of a 1*3 size. The operator 422 multiples the current intermediate data signal RGBW(k) and the filter coefficient of the re-sampling filter 413.

The self-sharpening filter 414 provides a filter coefficient for vertical and horizontal sharpening of color. The self-sharpening filter 414 may include a filter coefficient of a 1*3 size. The operator 424 multiples the current intermediate data signal RGBW(k) and the filter coefficient of the self-sharpening filter 414.

The box filter 415 is a filter for representing the point and diagonal of color. As shown in FIG. 10, the box filter 415 may include a filter coefficient of a 1*3 size. The operator 426 multiples the current intermediate data signal RGBW(k) and the filter coefficient of the box filter 415.

The operator 423 adds the outputs from the operators 421 and 422 to output a filtering data signal. The operator 425 adds the outputs of the operators 422 and 424 to output a filtering data signal.

The selection circuit 324 includes multiplexers 431 and 432, a Point and Diagonal (PD) filter circuit 433, and an orthogonal filter circuit 434.

The PD filter circuit 433 detects a point or a diagonal in a rendering area of a 3*3 size. The PD filter circuit 433 outputs a first selection signal SEL1 in response to the current intermediate data signal RGBW(k), the next intermediate data signal RGBW(k+1), and a previous flag signal FLAG(k−1). The PD filter circuit 433 determines whether or not a signal level of each of red, green, blue, and white color signals included in the current intermediate data signal RGBW(k) is higher than a reference level, and outputs flag signals RF, GF, BF, and WF corresponding to a determination result. The flag signals RF, GF, BF, and WF may be a total of 4 bits.

The orthogonal filter circuit 434, as shown in FIG. 11, detects whether or not a color signal corresponding to pixels arranged in a cross-like form is saturated by using an orthogonal filter of a three-by-three (3*3) pixel size and outputs a second selection signal SEL2 corresponding to a detection result. The second selection signal SEL2 may be outputted as a flag signal SF representing whether the color signal is saturated. The flag signal SF may be a one-bit signal.

The flag signals RF, GF, BF, and WF outputted from the PD filter circuit 433, and the flag signal SF outputted from the orthogonal filter circuit 434 are stored as the current flag signal FLAG(k) in the flag buffer 314 shown in FIG. 5. The current flag signal FLAG(k) may be a total of 5 bits.

Again, referring to FIGS. 5 and 6, when receiving the next intermediate data signal RGBW(k+1) from the postscaler 213, the rendering circuit 320 may output a rendering signal RG/BW on the basis of the next intermediate data signal RGBW(k+1), the current intermediate data signal RGBW(k) from the line buffer 312, and the previous flag signal FLAG(k−1) from the flag buffer 314. The line buffer 312 stores only the current intermediate data signal RGBW(k) corresponding to the current line (k corresponding to y2). Because the rendering circuit 320 refers to the five-bits previous flag signal FLAG(k−1) instead of the previous intermediate data signal RGBW(k−1) corresponding to the previous line (k−1 corresponding to y1), the size of the memory 310 may be reduced or minimized.

FIG. 12 is a view illustrating a configuration of the sub pixel rendering unit of FIG. 3 according to another embodiment of the inventive concept.

Referring to FIG. 12, a sub pixel rendering unit 214_1 includes a memory 510 and a rendering circuit 520. The memory 510 includes a flag buffer 512.

The flag buffer 512 provides a previous flag signal FLAG (k−1) to the rendering circuit 320 and stores a current flag signal FLAG(k) provided from the rendering circuit 320.

The rendering circuit 520 receives the second intermediate data signal RGBW' provided from the postscaler 213 of FIG. 3 as the current intermediate data signal RGBW(k), receives the previous flag signal FLAG(k−1) from the flag buffer 512, and outputs a rendering signal RG/BW. The rendering signal RG is provided to the first pixel PX1 of FIG. 2 and the rendering signal BW is provided to the second pixel PX2 of FIG. 2.

Figure 13:
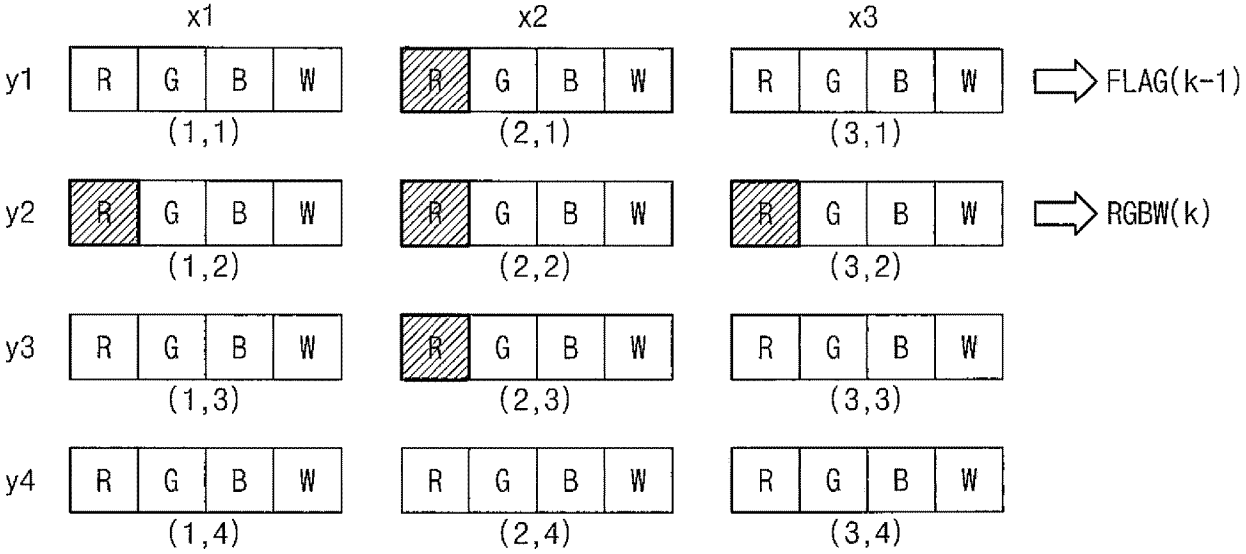
FIG. 13 is a conceptual diagram illustrating a second intermediate data signal corresponding to each of the pixels of a display panel shown in FIG. 1 in order to describe operations of a sub pixel rendering unit shown in FIG. 12.

FIG. 13 is a conceptual diagram illustrating a second intermediate data signal corresponding to each of the pixels of the display panel shown in FIG. 1 in order to describe operations of the sub pixel rendering unit shown in FIG. 12. Referring to FIG. 13, each pixel in a display panel is expressed in terms of x-y coordinates and/or (x, y) coordinates.

Referring to FIGS. 12 and 13, it is assumed that the second intermediate data signal RGBW' provided from the postscaler 213 of FIG. 3 is provided to the sub pixel rendering unit 214 in the order of coordinates (1, 1), (2, 1), (3, 1), . . . , (1, 2), (2, 2), (3, 2), . . . , (1, 3), (2, 3), and (3, 3). In the description below, the current line k corresponds to the y coordinate being y2, and a previous line k−1 corresponds to the y coordinate being y1.

When receiving the current intermediate data signal RGBW(k) corresponding to the current line (k corresponding to y2) from the postscaler 213 of FIG. 3, the rendering circuit 520 receives the previous flag signal FLAG(k−1) corresponding to a previous line (k−1 corresponding to y1) from the flag buffer 512.

For example, the red signal R corresponding to the coordinates (2, 2) may be converted into the red signal R corresponding to a red sub pixel of the coordinates (2, 2) in a PenTile pixel structure on the basis of the current intermediate data signal RGBW(k) corresponding to an adjacent position on the same line y2; that is, on the basis of the pixel of the coordinates (1, 2) and the pixel of the coordinates (3, 2) and the previous flag signal FLAG(k−1) corresponding to the pixels of the coordinates (1, 1), (2, 1), and (3, 1) disposed at a previous line y1.

The rendering circuit 520 may have a circuit configuration similar to that of FIG. 7. However, a PD filter circuit and an orthogonal filter circuit in the rendering circuit 520 do not receive the next intermediate data signal RGBW(k+1) corresponding to the next line, and operate in correspondence to the current intermediate data signal RGBW(k) and the previous flag signal FLAG(k−1).

Figure 14:
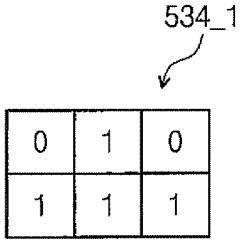
FIG. 14 is a view illustrating an orthogonal filter used in an orthogonal filter circuit in a rendering circuit shown in FIG. 13.

FIG. 14 is a view illustrating an orthogonal filter used in an orthogonal filter circuit in the rendering circuit shown in FIG. 13.

Referring to FIG. 14, the orthogonal filter circuit 14 in the rendering circuit 520 detects whether or not a color signal corresponding to pixels arranged in a cross-like form is saturated by using an orthogonal filter of a 3*2 pixel size and outputs a second selection signal SEL2 corresponding to a detection result.

In embodiments as described above, an image processing circuit having such a configuration may determine whether or not a data signal is saturated by using a previous flag signal instead of a previous data signal corresponding to a previous line. Accordingly, as only a data signal corresponding to the current line and a flag signal corresponding to a previous line are needed to be stored in a memory, the size of a memory necessary for operations of a rendering module may be reduced or minimized.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "connected to" another element, it can be directly connected to the other element, or one or more intervening elements may be present. When an element or layer is referred to as being "directly connected to" another element or layer, there are no intervening elements present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The image processing circuit and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the image processing circuit may be formed on one integrated circuit (IC) chip or on separate IC chips. Further, the various components of the image processing circuit may be implemented on a flexible printed circuit film, a tape carrier package (TCP), a printed circuit board (PCB), or formed on a same substrate. Further, the various components of the image processing circuit may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

The above-disclosed subject matter is to be considered illustrative and not restrictive, and the appended claims and equivalents thereof are intended to cover all such modifications, enhancements, and other embodiments, which fall within the true spirit and scope of the inventive concept. Thus, to the maximum extent allowed by law, the scope of the inventive concept is to be determined by the broadest permissible interpretation of the following claims and their equivalents, and shall not be restricted or limited by the foregoing detailed description.

What is claimed is:

1. An image processing circuit comprising: a mapper configured to convert an image signal into an intermediate data signal; and a renderer configured to convert the intermediate data signal into a data signal, wherein the renderer comprises: a memory configured to store the intermediate data signal and a flag signal; and a rendering circuit configured to output a data signal corresponding to a current line in response to a next intermediate data signal corresponding to a next line, a current intermediate data signal corresponding to the current line from the memory, and a previous flag signal corresponding to a previous line from the memory, and wherein the rendering circuit is configured to calculate a current flag signal corresponding to the current line based on the current intermediate data signal, the next intermediate data signal, and a previous flag signal corresponding to a previous line from a flag buffer.

2. The image processing circuit of claim 1, wherein the memory comprises: a line buffer configured to store the current intermediate data signal; and the flag buffer configured to store the previous flag signal.

3. The image processing circuit of claim 2, wherein the rendering circuit is configured to store the current flag signal in the flag buffer.

4. The image processing circuit of claim 3, wherein the rendering circuit comprises:

a filtering circuit configured to output a plurality of filtering data signals based on the current intermediate data signal and each of a plurality of filter coefficients; and a selection circuit configured to output one of the plurality of filtering data signals as the data signal in response to the current intermediate data signal, the next intermediate data signal, and the previous flag signal corresponding to the previous line from the flag buffer.

5. The image processing circuit of claim 4, wherein the filtering circuit comprises:

a first filter configured to provide a first filter coefficient;

a brightness calculator configured to calculate a brightness of the current intermediate data signal;

a first calculator configured to multiply the first filter coefficient and an output of the brightness calculator;

a second filter configured to provide a second filter coefficient;

a second calculator configured to multiply the current intermediate data signal and the second filter coefficient;

a third calculator configured to add an output of the first calculator and an output of the second calculator;

a third filter configured to provide a third filter coefficient;

a fourth calculator configured to multiply the current intermediate data signal and the third filter coefficient;

a fifth calculator configured to add an output of the second calculator and an output of the third calculator;

a fourth filter configured to provide a fourth filter coefficient; and a sixth calculator configured to multiply the current intermediate data signal and the fourth filter coefficient.

6. The image processing circuit of claim 5, wherein the first filter is a sharpening filter;

wherein the second filter is a re-sampling filter;

wherein the third filter is a self-sharpening filter; and wherein the fourth filter is a box filter.

7. The image processing circuit of claim 5, wherein the selection circuit comprises:

a first filter circuit configured to output a first selection signal in response to the current intermediate data signal, the next intermediate data signal, and the previous flag signal corresponding to the previous line from the flag buffer;

a first multiplexer configured to output one of an output signal of the fifth calculator and an output signal of the sixth calculator in response to the first selection signal;

a second filter circuit configured to output a second selection signal in response to the current intermediate data signal, the next intermediate data signal, and the previous flag signal corresponding to the previous line from the flag buffer; and a second multiplexer configured to output one of an output signal from the third calculator and an output signal from the first multiplexer as the data signal in response to the second selection signal.

8. The image processing circuit of claim 7, wherein the image signal comprises a first color signal, a second color signal, and a third color signal, and wherein the intermediate data signal comprises the first color signal, the second color signal, the third color signal, and a fourth color signal.

9. The image processing circuit of claim 8, wherein the first filter circuit is further configured to output a color flag signal representing whether each of the first color signal, the second color signal, the third color signal, and the fourth color signal of the current intermediate data signal is greater than a reference value;

wherein the second filter circuit is further configured to output a saturation flag signal according to a pattern of the current intermediate data signal; and wherein the flag buffer is configured to store a current flag signal comprising the color flag signal and the saturation flag signal.

10. A display device comprising: a display panel comprising a plurality of pixels displaying an image corresponding to data signals; and an image processing circuit configured to receive an image signal, to convert the image signal into a data signal of the data signals, and to provide the data signal to the display panel, wherein the image processing circuit comprises: a mapper configured to convert the image signal into an intermediate data signal; and a renderer configured to convert the intermediate data signal into the data signal, the renderer comprising: a memory configured to store the intermediate data signal and a flag signal; and a rendering circuit configured to output the data signal corresponding to a current line in response to a next intermediate data signal corresponding to a (k+1)th line among a plurality of lines of the display panel, a current intermediate data signal corresponding to a kth line from the memory, and a previous flag signal corresponding to a (k−1)th line from the memory, and wherein the rendering circuit is configured to calculate a current flag signal based on the current intermediate data signal, the next intermediate data signal, the previous flag signal corresponding to the (k−1)th line from a flag buffer.

11. The display device of claim 10, wherein the memory comprises: a line buffer configured to store the current intermediate data signal; and the flag buffer configured to store the previous flag signal.

12. The display device of claim 11, wherein the rendering circuit is configured to store the current flag signal in the flag buffer.

13. The display device of claim 11, wherein the rendering circuit comprises:

a filtering circuit configured to output a plurality of filtering data signals based on the current intermediate data signal and each of a plurality of filter coefficients; and a selection circuit configured to output one of the plurality of filtering data signals as the data signal in response to the current intermediate data signal, the next intermediate data signal, and the previous flag signal corresponding to a previous line from the flag buffer.

14. The display device of claim 13, wherein the filtering circuit comprises:

a first filter configured to provide a first filter coefficient;

a brightness calculator configured to calculate a brightness of the current intermediate data signal;

a first calculator configured to multiply the first filter coefficient and an output of the brightness calculator;

a second filter configured to provide a second filter coefficient;

a second calculator configured to multiply the current intermediate data signal and the second filter coefficient;

a third calculator configured to add an output of the first calculator and an output of the second calculator;

a third filter configured to provide a third filter coefficient;

a fourth calculator configured to multiply the current intermediate data signal and the third filter coefficient;

a fifth calculator configured to add an output of the second calculator and an output of the third calculator;

a fourth filter configured to provide a fourth filter coefficient; and a sixth calculator configured to multiply the current intermediate data signal and the fourth filter coefficient.

15. The display device of claim 14, wherein the first filter is a sharpening filter;

wherein the second filter is a re-sampling filter;

wherein the third filter is a self-sharpening filter; and wherein the fourth filter is a box filter.

16. The display device of claim 14, wherein the selection circuit comprises:

a first filter circuit configured to output a first selection signal in response to the current intermediate data signal, the next intermediate data signal, and the previous flag signal corresponding to the previous line from the flag buffer;

a first multiplexer configured to output one of an output signal of the fifth calculator and an output signal of the sixth calculator in response to the first selection signal;

a second filter circuit configured to output a second selection signal in response to the current intermediate data signal, the next intermediate data signal, and the previous flag signal corresponding to the previous line from the flag buffer; and a second multiplexer configured to output one of an output signal from the third calculator and an output signal from the first multiplexer as the data signal in response to the second selection signal.

17. The display device of claim 16, wherein the image signal comprises a first color signal, a second color signal, and a third color signal, and wherein the intermediate data signal comprises the first color signal, the second color signal, the third color signal, and a fourth color signal.

18. The display device of claim 17, wherein the first filter circuit is further configured to output a color flag signal representing whether each of the first color signal, the second color signal, the third color signal, and the fourth color signal of the current intermediate data signal is greater than a reference value, wherein the second filter circuit is further configured to output a saturation flag signal according to a pattern of the current intermediate data signal, and wherein the flag buffer is configured to store a current flag signal comprising the color flag signal and the saturation flag signal.

19. The display device of claim 18, wherein the flag buffer is configured to store previous flag signals corresponding to a plurality of pixels in one line, the plurality of pixels being sequentially arranged along a first direction of the display panel, and the previous flag signals comprising the previous flag signal.

20. The display device of claim 19, wherein the line buffer is configured to store the intermediate data signal corresponding to a plurality of pixels in one line, the plurality of pixels being sequentially arranged along the first direction of the display panel.

* * * * *